US012736317B2

(12) United States Patent
Connetti

(10) Patent No.: US 12,736,317 B2
(45) Date of Patent: Sep. 15, 2026

(54) DEVICE AND METHOD FOR RELOADING AMMUNITION

(71) Applicant: Mighty Armory, LLC, Cranston, RI (US)

(72) Inventor: Wayne Patrick Connetti, Cranston, RI (US)

(73) Assignee: Mighty Armory, LLC, Cranston, RI (US)

( * ) Notice: Subject to any disclaimer, the term of this patent is extended or adjusted under 35 U.S.C. 154(b) by 0 days.

(21) Appl. No.: 19/357,969

(22) Filed: Oct. 14, 2025

(65) Prior Publication Data

US 2026/0104239 A1 Apr. 16, 2026

Related U.S. Application Data

(60) Provisional application No. 63/706,443, filed on Oct. 11, 2024.

(51) Int. Cl.
*F42B 33/04* (2006.01)

(52) U.S. Cl.
CPC ..... *F42B 33/04* (2013.01)

(58) Field of Classification Search
CPC ..... F42B 33/04; F42B 33/10
USPC ..... 86/36
See application file for complete search history.

(56) References Cited

U.S. PATENT DOCUMENTS 4,522,102 A * 6/1985 Pickens ..... F42B 33/004 86/27
5,649,465 A * 7/1997 Beebe ..... F42B 33/10 86/24
10,794,676 B1 * 10/2020 Aerni ..... F42B 33/10
11,326,864 B1 * 5/2022 McPherson ..... F42B 33/005
11,874,097 B1 1/2024 Aerni

FOREIGN PATENT DOCUMENTS

NL 1000769 C2 * 1/1997 ..... F42B 33/04

* cited by examiner

*Primary Examiner* — Bret Hayes
(74) *Attorney, Agent, or Firm* — Nelson Mullins Riley & Scarborough LLP; Anthony A. Laurentano

(57) ABSTRACT

A reloading die comprising a die housing, a cap element, and a guide element. The die housing has an inner surface forming a housing chamber. The cap element is coupled to a first end of the die housing, and the guide element is coupled to a second end of the die housing for mounting at least in part in the housing chamber. The guide element has a main body having a first end portion and an opposed second end portion and an inner surface defining a guide chamber. The inner surface of the guide element has disposed at a position axially spaced from a first end portion and from a second end portion a radially inwardly extending guide flange element. The guide flange element has a guide flange opening formed therein, and is configured and positioned to move axially within the housing chamber.

20 Claims, 3 Drawing Sheets

DEVICE AND METHOD FOR RELOADING AMMUNITION

RELATED APPLICATION

The present application claims priority to U.S. provisional patent application Ser. No. 63/706,443, filed on Oct. 11, 2024, and entitled Device and Method For Reloading Ammunition, the contents of which are herein incorporated by reference.

BACKGROUND OF THE INVENTION

The present invention relates to ammunition used in firearms, and more particularly relates to improvements in the methods and apparatus for reloading ammunition cartridges, including the use of reloading dies, to enhance efficiency, precision, and safety in the reloading process.

Ammunition cartridges are typically composed of four main components, namely, a case, a primer, a propellant (e.g., powder), and a projectile or bullet. In conventional ammunition, once a round has been fired, the ammunition casing is often ejected from the firearm and can be reused for subsequent reloading. The casing is often formed of malleable material, such as brass. The practice of reloading the spent ammunition casing involves manually or semi-automatically reconstructing an expended cartridge by inserting new ammunition components (e.g., primer, propellant, and bullet) into the previously used case. This practice has been widely adopted among firearm enthusiasts, competitive shooters, and hunters as a cost-effective alternative to purchasing new ammunition, and it allows for customization of loads for specific shooting needs. Reloading spent cartridges has several benefits, including reduced cost, environmental conservation (by reusing the brass casings), and the ability to tailor loads for optimal accuracy or specific applications. However, the conventional reloading process involves several steps that require precision and careful handling to ensure the reloaded cartridge functions safely and reliably.

The process of reloading ammunition cartridges conventionally involves several main steps. Initially, after the initial firing, the spent ammunition casing is collected and cleaned to remove any carbon residue or dirt that can interfere with subsequent reloading steps. The cases are often cleaned using, for example, a tumbler filled with media (such as walnut shells or steel pins) or ultrasonic cleaners to ensure that no debris remains inside or outside the ammunition casing. Further, upon firing, the high pressure within the chamber of the casing causes the brass case to expand slightly. The case thus needs to be resized to its original dimensions to fit properly in the firing chamber of the firearm. This is typically accomplished using a reloading die.

As is known, there are two conventional types of resizing, namely full-length resizing and neck resizing. In full-length resizing, the entire case, including the neck and body, is resized to original factory specifications. This is commonly used for semi-automatic firearms or firearms that use detachable magazines. In neck resizing, only the neck of the case is resized, which is often sufficient for bolt-action rifles where the cases are used in the same firearm repeatedly.

As part of the reloading process, the spent primer, located in a primer pocket of the casing chamber, needs to be removed using a decapping die or pin. After removal, a new primer is seated in the primer pocket using a primer seating tool. Proper seating ensures that the primer is flush with or slightly below the case head to avoid misfires. Once the primer is reloaded, the next step is to add the correct amount of propellant (e.g., gunpowder) into the resized and primed case. The amount of powder directly affects the bullet's velocity, trajectory, and pressure generated within the firearm. The powder is typically measured using a powder scale or an automated powder dispenser to ensure accuracy. The projectile (e.g., bullet) is then placed into the mouth of the case, and the case mouth is often slightly expanded or "flared" using a mouth expander die to facilitate bullet seating. A seating die is used to press the bullet into the case to the desired depth. Ensuring consistent seating depth is critical for accuracy and proper chambering of the cartridge. In some reloading processes, particularly with cartridges used in semi-automatic firearms or revolvers, the case mouth can be crimped around the bullet to secure it in place and prevent any movement during handling or firing. Crimping is achieved using a crimping die and is especially needed when bullets lack a cannelure (a groove around the bullet) that facilitates secure crimping.

The reloading dies are essential tools in the reloading process and come in various configurations depending on the type of cartridge being reloaded. The conventional dies are typically made from hardened steel or carbide and are threaded to fit into a reloading press. While conventional reloading methods and dies are widely used, they are not without limitations. The precision of reloaded cartridges can vary based on the consistency of the reloading process, the quality of the dies, and the skill of the reloader. Additionally, the need to perform multiple steps in sequence can be time-consuming, and improper handling can result in misfires or dangerous over-pressured rounds.

SUMMARY OF THE INVENTION

The present invention is directed to a reloading die, and specifically to a decapping die, that enables the die to remove or decap a spent primer from an ammunition casing. The reloading die of the present invention includes a cap element, a die housing, a guide element, a spacer element, an ejector rod, and an ejector pin. The cap element is coupled to one end of the die housing and the guide element is coupled to the opposed end of the die housing. The guide element has an inner surface that defines a guide chamber. The guide element has openings formed at either end thereof that open onto the guide chamber. The inner surface includes a flange element that extends radially inwardly into the guide chamber. The flange element is positioned away from the ends of the guide element, and according to one embodiment, is positioned at an intermediate position along the axial length of the guide element. The flange element can be shaped on one side to seat the tip of the ammunition casing, and can be configured on an opposite side to form a spring seat to seat one end of a biasing element. The guide flange element can have an opening formed therein.

The cap element has an inner surface forming cap walls and a cap floor that defines a cap chamber. The cap floor can include a cap flange element that extends or protrudes outwardly therefrom. The cap flange element can have a cap bore formed therein. The chamber walls can include, at least along selected axial portions, threads for engaging threads on a neck portion of the die housing. The spacer element is mounted in the same end of the die housing as the cap element, and has a central opening that seats the ejector rod. The top portion of the ejector rod extends outwardly from the spacer element into the cap chamber, and a portion of the top portion of the ejector rod seats within the cap bore. A first biasing element is seated within the cap chamber between the top portion of the ejector rod and the floor of the cap element. Specifically, one end of the biasing element seats about the cap flange element, which forms a spring seat, and an opposed end of the biasing element contacts the ejector rod. The first biasing element applies an axial force on the ejector rod to keep the rod disposed in a selected axial position.

The ejector rod also has an intermediate portion and a bottom portion. A selected portion of the intermediate portion of the ejector rod seats within the opening of the spacer element and extends into a housing chamber formed by the inner wall of the die housing. The bottom portion of the ejector rod includes a bore or opening formed therein for seating the ejector pin. The guide element is captured at the end of the die housing opposite the cap element via a housing flange element formed in the die housing for capturing and seating the guide element. A second biasing element is disposed within the housing chamber between the spacer element and the guide element. The second biasing element provides an axial force on the guide element to dispose the guide element in a deployed position. In the deployed position, a portion of the guide element extends outwardly from the die housing and hence from the housing chamber. Also, in the deployed position, the tip of the ejector pin is aligned with the opening in the guide flange element and is positioned adjacent thereto. When an axial force is applied to the guide element or reloading die, the guide element is pushed into the housing chamber in a direction opposite to the force applied by the second biasing element. As the guide element continues to move axially into the housing chamber, the ejector pin tip moves into and through the opening in the guide flange element. The tip of the ejector pin eventually contacts the spent primer in the ammunition casing and removes the primer therefrom.

The present invention is directed to a reloading die for reloading an ammunition cartridge comprising a die housing, a cap element, and a guide element. The die housing has a main body having a first end and an opposed second end, and an outer surface and an opposed inner surface forming a housing chamber. The cap element is coupled to the first end of the die housing, and the guide element is coupled to the second end of the die housing and for mounting at least in part in the housing chamber. The guide element has a main body having a first end portion and an opposed second end portion and an inner surface defining a guide chamber. The first end portion has a first guide opening formed therein at a first end face for communicating with the guide chamber and the second end portion has a second guide opening formed therein at a second end face for communicating with the guide chamber. The inner surface of the guide element has disposed at a position axially spaced from the first end portion and from the second end portion a radially inwardly extending guide flange element. The guide flange element has a guide flange opening formed therein, and the guide flange element forms, from the guide chamber, an upper guide chamber and a lower guide chamber. The guide element is configured and positioned to move axially within the housing chamber.

The cap element has a main body having an outer surface and an inner surface forming a cap chamber, and the inner surface of the main body of the cap element has a cap flange element extending axially inwardly into the cap chamber and is sized and configured to form a first spring seat for seating one end of a first biasing member. The cap flange element has a central opening formed therein that communicates with the cap chamber. The first end of the die housing has a neck portion having threads formed on an outer surface thereof, and at least a portion of the inner surface of the cap element has threads formed thereon for threadingly engaging with the neck portion. The first end of the die housing also has a shoulder portion formed thereon that is disposed adjacent to the neck portion and has a diameter that is greater than a diameter of the neck portion. Further, the second end of the main body of the die housing has a radially inwardly extending housing flange portion that is disposed at the end face that has a bore opening formed therein for communicating with the housing chamber.

The first end portion of the guide element has a diameter that is greater than a diameter of the bore opening formed in the housing flange portion of the die housing so as to retain the guide element within the housing chamber. The inner surface of the guide flange element in the lower guide chamber is relatively flat at least adjacent to the second guide opening at the end face. The first guide opening opens onto the upper guide chamber and the second guide opening opens onto the lower guide chamber. The lower guide chamber has a lower chamber section disposed at the end face region that has a flat inner surface that extends axially from the second guide opening at least partly along the lower guide chamber, and an upper chamber section adjacent to the lower chamber section and axially spaced away from the second guide opening. The lower chamber section has a flat inner wall and the upper chamber section has a curved inner surface that terminates at the guide flange element. The upper guide chamber has a relatively flat inner surface that terminates in a curved wall surface adjacent to the guide flange element forming a second spring seat for a second biasing member.

The reloading die also includes a spacer element having a main body having a top portion forming a shoulder region and an extension portion that extends axially outwardly from the top portion. The top portion has a diameter that is greater than a diameter of the extension portion and of the neck portion, and the extension portion has threads formed thereon for engaging with the threads on the inner surface of the neck portion. The main body of the spacer element has a central spacer opening formed therein that extends through the main body and the extension portion of the spacer element seats within the neck portion and within the chamber housing.

The cap element has a main body having an outer surface and an inner surface forming a cap chamber. The inner surface of the main body of the cap element has a cap flange element extending axially inwardly into the cap chamber and sized and configured to form a first spring seat for seating one end of a first biasing element, wherein the cap flange element has a cap bore formed therein that communicates with the cap chamber, further comprising an ejector rod having a main body having a top section, an intermediate portion, and a bottom portion. The top section is sized and configured to seat within the cap chamber and is mounted between the spacer element and the cap flange element when assembled. The top section includes a shoulder portion that extends radially outwardly from the main body that is sized and dimensioned to abut against the top portion of the spacer element, and an extension component that extends axially outwardly from a top surface of the top section that is sized and configured to seat within the cap bore formed in the cap flange element. The extension component is axially movable within the cap bore. The intermediate portion axially extends within the housing chamber, and the bottom portion has a pin bore formed therein. At least a portion of the intermediate portion seats within the central spacer opening of the spacer element to position and guide the ejector rod within the housing chamber, and the top section is sized and configured to seat within the cap chamber and is mounted between the spacer element and the cap flange element. The first biasing element seats about the cap flange element and is captured between the cap element and the shoulder portion of the top section of the ejector rod. The first biasing element applies a force against the top section of the ejector rod to place the shoulder portion in contact with the spacer element.

The reloading die also includes an ejector pin that is sized and configured for mounting in the pin bore. The ejector pin has a main body that includes an upper portion that has threads formed thereon for threadingly engaging with the pin bore, an intermediate portion, and a pin end portion disposed opposite the upper portion. A second biasing element is mounted within the housing chamber of the die housing and is positioned to contact at one end a bottom surface of the extension portion of the spacer element and at an opposite end with the guide flange element of the guide element in the upper guide chamber. The ejector pin is aligned with the guide flange opening, and the guide element is movable between a deployed position and a retracted position, and when disposed at least in the retracted position, a portion of the ejector pin passes through the guide flange opening.

The present invention also includes a reloading die for removing a spent primer from an ammunition casing. The reloading die includes a die housing having a main body having a first end and an opposed second end, the main body having an outer surface and an opposed inner surface forming a housing chamber; a spacer element coupled to the first end of the die housing and having a central spacer opening; an ejector rod having a main body having a top section, an intermediate section and a bottom section, wherein the top section is sized and configured to contact the spacer element and a portion of the intermediate section seats within the central spacer opening; an ejector pin coupled to the bottom section of the ejector rod; a cap element coupled to the first end of the die housing and having an inner surface forming a cap chamber, wherein at least the top section of the ejector rod seats within the cap chamber; a first biasing member disposed in the cap chamber and contacting the top section of the ejector rod and the inner surface of the cap element; a guide element coupled to the second end of the die housing and for mounting at least in part in the housing chamber, the guide element having a main body having a first end portion and an opposed second end portion and an inner surface defining a guide chamber; and a second biasing member disposed within the housing chamber and coupled at a first end to the spacer element and coupled at a second end to the guide element. The second end of the second biasing member seats within the guide chamber. The inner surface of the guide element has a guide flange element formed thereon for seating the second end of the second biasing member, and the guide flange element is disposed in the guide chamber between the first end portion and second end portion.

BRIEF DESCRIPTION OF THE DRAWINGS

These and other features and advantages of the present invention will be more fully understood by reference to the following detailed description in conjunction with the attached drawings in which like reference numerals refer to like elements through the different views. The drawings illustrate principals of the invention and, although not to scale, show relative dimensions.

DETAILED DESCRIPTION OF THE INVENTION

As used herein, the term "ammunition" refers to or means one or more devices designed to be fired from a firearm or weapon and configured to deliver a projectile, payload, or projectile-containing charge to a target. The ammunition can include, for example, ballistic cartridges, rimfire cartridges, centerfire cartridges, shotshells, and other packaged propulsive charge and projectile assemblies.

As used herein, the term "ammunition cartridge" or "cartridge" can refer to or mean, either in singular or in plural form, a single packaged round of ammunition that includes, in whole or in part, a case or casing (e.g., shell), a primer or primer assembly, a propellant charge (e.g., powder), and one or more projectiles or payloads (e.g., a bullet, shot, slug, or the like). The cartridge can be centerfire or rimfire and can include additional elements, such as a wad, crimp, sealant, or internal spacers depending on the cartridge type.

The reloading die tool of the present invention is directed to an ammunition cartridge case reloading die, which can also be referenced herein as a reloading die, reloading die tool, or decapping die. In the illustrated embodiment, the reloading die can be a dedicated decapping die that can be used when reloading ammunition to remove the spent primer from a used ammunition cartridge case. The reloading die is part of the reloading process, where shooters and reloaders prepare the cases for reuse by replacing the primer, powder, and bullet. The reloading die helps push out or ram the spent primer (e.g., the small ignition component in the center of the cartridge base) from the fired ammunition case. The spent primer removal step is part of the reloading process to make the case ready for priming with a new, unfired primer. The reloading die accomplishes this by using a pin or rod (e.g., a ram) that pushes the primer out through a flash hole, which is typically a small opening inside the case that directs the ignition spark. After decapping, the case can be cleaned and resized for reuse. The reloading die of the present invention can also optionally incorporate additional features encompassing other cartridge case post-firing processing steps without departing from the spirit and scope of the present invention. Furthermore, the elements and features of the reloading die disclosed herein can be adapted to other dies beyond the illustrated decapping die. Those having ordinary skill in the art will recognize the modifications for making such adaptations, and thus such modifications are deemed to be within the scope of the present invention.

Figure 1:
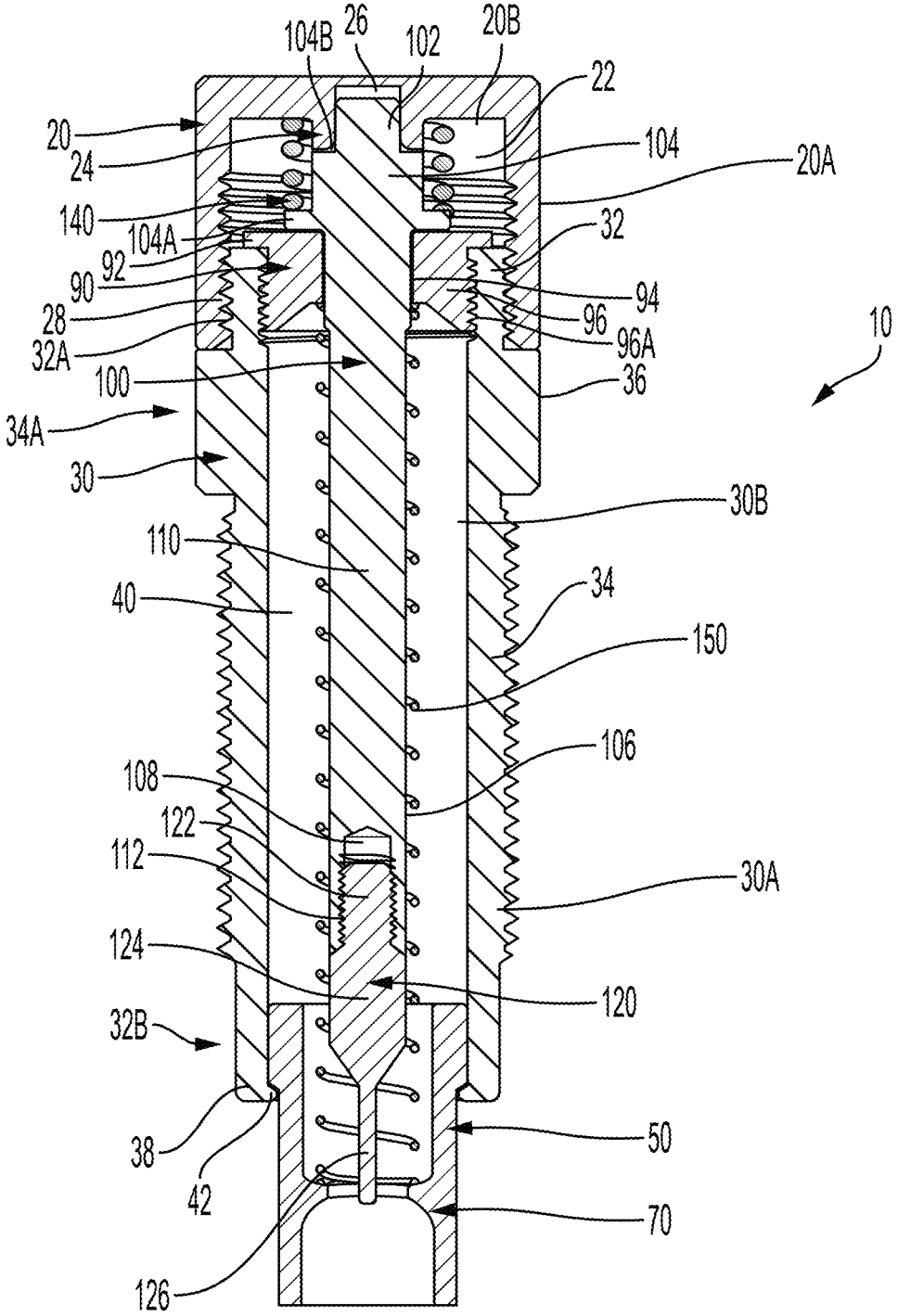
FIG. 1 is a cross-sectional view of reloading die suitable for removing a primer from an ammunition cartridge according to the teachings of the present invention.
Figure 2:
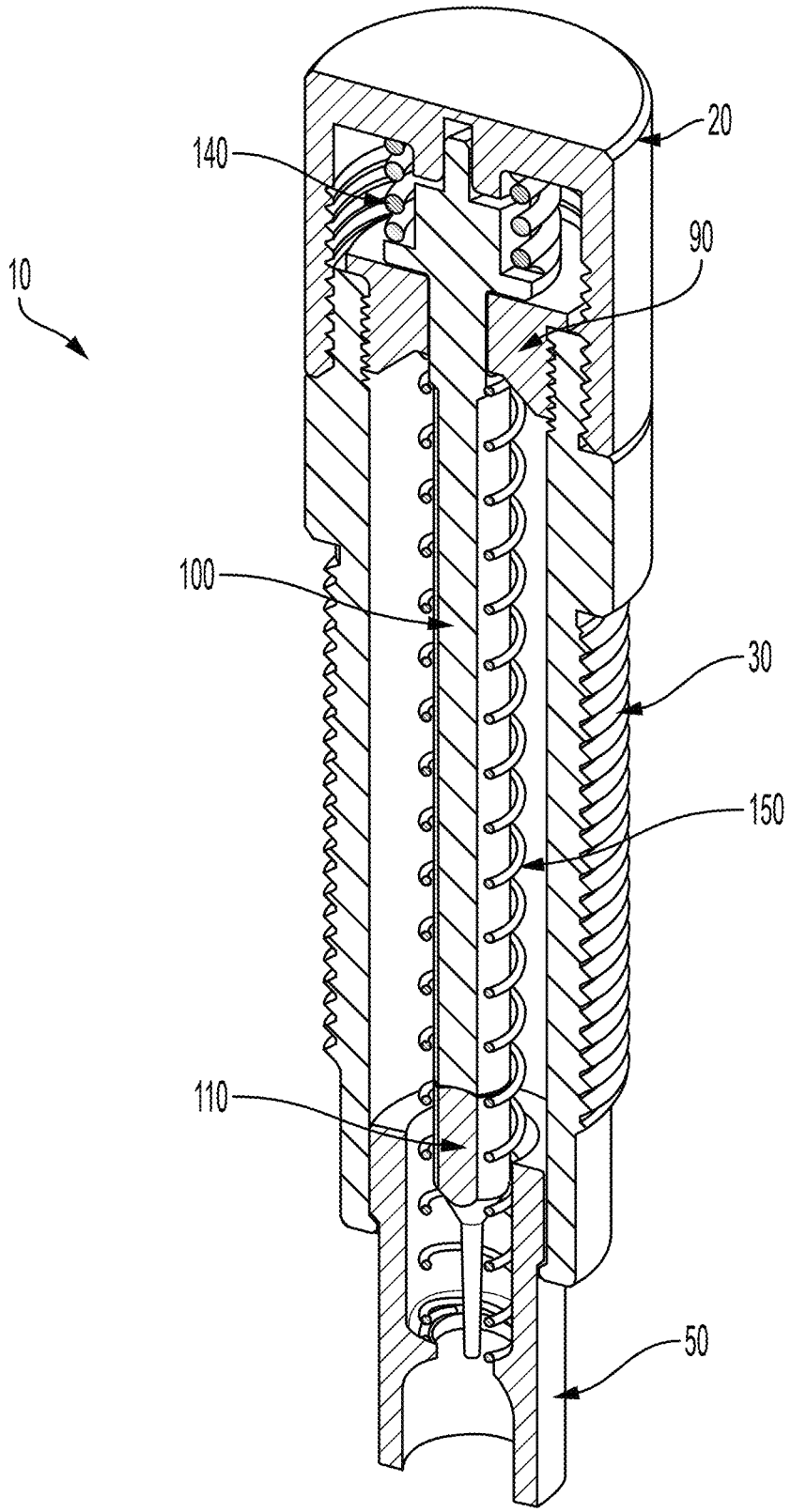
FIG. 2 is a perspective cross-sectional view of the reloading die of FIG. 1 according to the teachings of the present invention.

The reloading die of the present invention is shown, for example, in FIGS. 1 and 2. The illustrated reloading die 10 includes at one end a cap element 20 having a main body having an outer surface 20A and an inner surface 20B that forms an inner cap chamber 22. The inner surface 20B has a flange element 24 that ends axially inwardly into the cap chamber 22. The flange element 24 has a central bore 26 formed therein that is sized and configured for seating an end portion of an ejector rod 100. The flange element 24 functions as a spring holder or seat for a biasing element 140, such as a spring element. The inner surface 20B of the cap element 20 has a portion that has threads 28 formed thereon for threadingly engaging with a die housing 30.

The illustrated reloading die 10 also includes a die housing 30 having an elongated main body 34 that extends along a longitudinal axis having an outer surface 30A and an opposed inner surface 30B forming a housing chamber 40. The die housing 30 can be mounted within a suitable reloading station. The main body 34 also includes a first end portion 34A having a neck portion 32 that has threads 32A formed thereon for threadingly engaging with the threads 28 formed in the inner surface 20B of the cap element 20. The first end portion 34A also includes a shoulder portion 36 that has an outer diameter that is larger than the diameter of the threaded neck portion 32 to form a thickened housing section. The main body 34 also includes an opposed second end portion 32B forming a terminal end portion. The inner surface 30B of the main body at the terminal end portion 32B has a radially inwardly extending neck or flange portion 38 that has a bore 42 formed therein. The bore 42 forms at the second end portion 32B an entrance or opening of the housing chamber 40.

Figure 3:
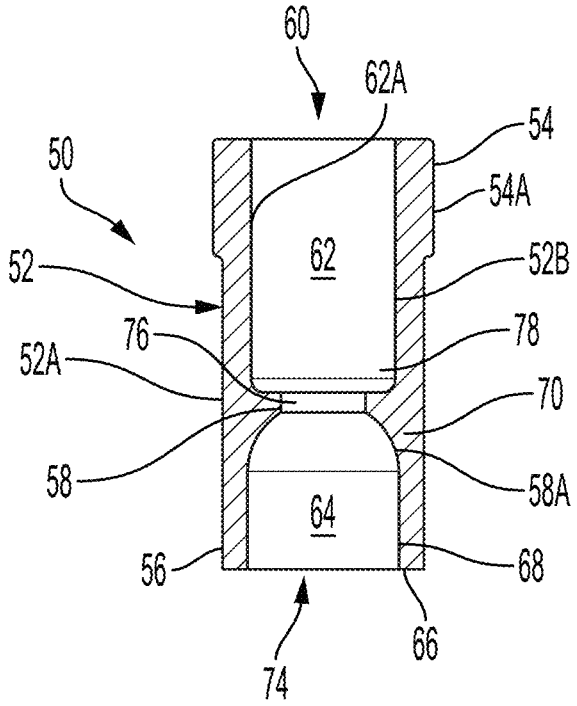
FIG. 3 is a cross-sectional view of the guide element of the reloading die FIG. 1 according to the teachings of the present invention.

The terminal end portion 32B of the die housing 30 is sized and configured for seating a guide element 50. As shown for example in FIGS. 1-3, the guide element 50 has a main body 52 having a first end portion 54 and an opposed second end portion 56, and also includes an outer surface 52A and an inner surface 52B forming a guide chamber 60. The first end portion 54 has a diameter that is greater than a diameter of the second end portion 56. As such, the first end portion 54 forms a shoulder region or portion 54A. The outer diameter of the shoulder region 54A is greater than a diameter of the bore 42 formed in the die housing. As such, when the guide element is disposed within the housing chamber 40, the second end 56 of the guide element 50 passes through the bore 42 and the flange 42 of the die housing contacts the shoulder region 54A of the guide element 50 so as to retain the first end portion 54 of the guide element within the housing chamber 40. The second end portion 56 of the guide element 50 can pass through and extend or project outwardly from the bore 42 and hence from the terminal end of the die housing 30. Further, in a fully deployed position (FIG. 3), the first end portion 54 of the guide element 50 contacts and seats against the flange portion 38 of the die housing 30. The guide element 50 also includes an opposed second end portion 56 that has a diameter smaller than the diameter of the bore 42, such that the second end portion 56 and associated region of the guide element 50 freely passes through the bore 42.

The inner surface 52B of the guide element 50 has a radially inwardly extending flange region or element 58. The flange region 58 separates, at least in part, the guide chamber 60 into separate and discrete chambers, such as an upper guide chamber 62 and a lower guide chamber 64. The upper and lower guide chambers can communicate with each other. The flange region 58 is disposed at a position that is axially spaced from the terminal ends of the first end portion 54 and from the second end portion 56. The flange region 58 can include a flange or intermediate opening 76 that allows the upper and lower guide chambers to communicate with each other. The guide element has an opening 74 formed in a terminal end face 66 of the second end portion 56 so as to form an entrance opening for the guide chamber 60, and specifically for the lower guide chamber 64. The entrance opening 74 and the lower guide chamber 64 can be sized and configured for receiving an ammunition casing (not shown). The lower guide chamber 64 can have a first lower chamber section 68 that has an inner surface, corresponding at least in part to the inner surface 52B of the guide element, that is non-tapered and generally and relatively flat and straight that extends axially from the end face 66 part way along the lower guide chamber 64. The lower guide chamber 64 also includes an upper guide chamber section 70 adjacent to the lower guide chamber section 68 that is axially spaced away from the end face 68 and from the entrance or face opening 74. The upper guide chamber section 70 terminates at the flange region 58 and has a generally curved inner surface 58A that terminates at the flange region 58, and specifically at the intermediate opening 76 formed in the flange region 58. The curved inner surface 58A helps seat a top portion of the ammunition casing in the lower guide chamber 64 and helps center the casing in the guide element 50 and relative to the intermediate opening 78 in the flange region 58. Further, the upper guide chamber 62 has a relatively flat inner surface 62A that terminates in a curved wall section adjacent to the flange region 58 to form a spring seat 78 for the biasing member 150.

With reference again to FIGS. 1 and 2, the illustrated reloading die 10 further includes a spacer element 90 that has a main body having a top portion 92 forming a shoulder portion and an extension portion 96 that extends axially outwardly from the top portion 92. The top portion 92 has an outer diameter that is greater than an outer diameter of the extension portion 96 and greater than the outer diameter of the neck portion 32 of the die housing 30. The extension portion 96 has threads 96A formed thereon for engaging with threads formed on an inner surface of the neck portion 32. The spacer element 90 has a central opening 94 formed therein that extends therethrough. The extension portion 96 seats within the housing chamber 40 when the spacer element 90 is coupled to the die housing 30, and specifically when the extension portion 96 is inserted into the neck portion 32 of the die housing.

The illustrated reloading die 10 also includes an ejector rod 100. The central opening 94 of the spacer element 90 helps position and guide within the housing chamber 40 the ejector rod 100. The illustrated ejector rod 100 has a main body having a top or upper section 104 that is sized and configured to seat within the cap chamber 22 and is mounted between the spacer element 90 and the flange 24 of the cap element 20. The upper section 104 has a shoulder portion 104A that extends radially outwardly from the main body. The shoulder portion 104A is sized and dimensioned to seat or abut against a top surface of the top portion 92 of the spacer element 90. The upper section 104 has a top surface 104B that has an extension component 102 that extends axially outwardly therefrom. The extension component 102 is sized and configured to seat within the bore 26 formed in the flange 24. When mounted therein, there is a space or gap formed between the axially outermost extent of the extension component and the floor portion of the bore to allow for limited axial movement of the extension component, and hence the ejector rod, within the bore and the housing chamber 40. The cap chamber 22 also mounts a biasing element 140 that seats about the flange 24, which functions as a spring seat, and is captured between the cap element inner surface and the shoulder portion 104A of the upper section 104 of the ejector rod 100. The biasing element 140 applies a pressure or force against the upper section 104 of the ejector rod 100 to place the upper portion 104 in contact with the spacer element 90.

The main body of the ejector rod 100 also has an intermediate section 110 that passes through and seats within the opening 94 of the spacer element 90 while concomitantly seating within the housing chamber 40. The ejector rod main body also includes a lower or bottom portion 106 that also extends into the housing chamber 40 of the die housing 30. The bottom portion 106 has an opening, such as a threaded pin bore 108, formed at a terminal end 112 that is sized and configured for receiving and mounting an ejector tip or pin 120. The illustrated ejector pin 120 has a main body having an upper portion 122 that has threads for threadingly engaging with the pin bore 108, an intermediate portion 124, and a pin end portion 126 disposed opposite the upper portion 122. A second biasing element 150, such as a spring, is mounted within the housing chamber 40 of the die housing 30 and contacts at one end an underside (e.g., bottom surface) of the spacer element 90, such as the underside of the extension portion 96, and at an opposite end with the flange 58 of the guide element 50 in the upper guide chamber 62. The underside or bottom of the spacer element 90 can be configured in any suitable way to form a seat for the second biasing element 150. The biasing element 150 biases the guide element 50 into one or more operational positions, such as in the illustrated deployed position. In the deployed position, the first biasing member 140 biases the ejector rod such that the shoulder 104A contacts the spacer element 90 and the second biasing element 150 biases the guide element so that the shoulder region 54A contacts the flange 38. In this position, the pin portion 126 of the ejector pin 120 is positioned within the upper guide chamber 62 of the guide element 50 in close proximity or adjacent to the flange element 58. According to one embodiment, the pin portion 126 of the ejector pin 120 is aligned with the intermediate opening 76 of the guide element and sets within or partly passes through the opening 76. According to another embodiment, the pin portion 126 is sized and configured for passing through the intermediate opening 76 of the flange element 58. Further, the pin portion 126 can be positioned to be axially spaced from the end face 66 and associated opening 74 of the guide member 50. Conversely, if a pressure is applied to the guide element 50 in a direction opposite to the force applied by the biasing element 150, then the guide element 50 moves axially inwardly into the housing chamber 40 into a selected retracted position. In this position, the pin portion 126 extends into the lower guide chamber 64 and hence into the cartridge casing when coupled to the lower guide chamber 64.

The illustrated reloading die 10 helps guide an ammunition or cartridge casing into the die in order to remove a spent primer from the cartridge casing, and to eject the primer, if needed, if the primer becomes attached to the pin portion 126 (e.g., removal pin). Further, the reloading die 10 can be easily assembled without the use of tools. The limited axial movement of the upper section 104 of the ejector rod 100 within the cap chamber 22 of the cap element 20 enables removal of any primer that may be attached to the pin portion 126 during the removal process. According to another technique, the primer ejection can occur when the pressure applied to the guide element 50 is lessened or removed, and the guide element 50 is pushed back into the deployed position by the biasing member 150. The ejector pin 120 moves back through the chambers of the guide element 50, and the flange element 58 can then contact and push the primer off of the ejector pin 120. Still further, the screw-on cap element 20 allows the user to adjust the tension on the biasing element 140 by rotating the cap element on the die housing in a selected direction. Further, the cap flange element 24 is sized and dimensioned to not only guide the biasing element 140 and to form a spring seat, but also to hold or retain the biasing element 140 to assist during assembly of the reload die 10. The spacer element 90 helps position and guide the ejector rod 100 within the housing chamber as well as contain the biasing element 150 within the housing chamber 40, as well as to automatically center the biasing element during assembly. The ejector rod 100 helps hold the ejector pin 90 (e.g., decapping pin) or other optional end piece by mating threads or any other type of connection technique. The ejector rod 100 is also configured to be self-centering and self-locking by way of a taper fit between the ejector pin 90 and the ejector rod 100. The guide element 50 enables the cartridge casing to be self-centering against the guide element by means of a curved upper chamber portion 70 formed in the lower guide chamber of the guide element 50. The guide flange element 58 can also be configured in a manner to form a spring seat 78. The spring seat 78 can be formed as a recess. The recess can also be configured to self-center the biasing element 150 by means of a chamfer or radius at the bottom of the recess.

In operation, a mouth of a cartridge casing (the mouth is the open end of a cartridge casing that holds the projectile) is inserted by the user into the lower guide chamber 64 of the guide element 50. The mouth portion of the casing contacts the upper chamber section 70 of the lower guide chamber 64 and the curved portion of the upper chamber section 70 helps center the casing within the guide element 50 and relative to the opening in the guide flange element. As the cartridge casing continues to travel into the guide element 50 of the reload die 10, the biasing element 150 keeps tension on the guide element 50 and hence the cartridge casing to maintain the position of the casing relative to the guide element and the die housing 30. The biasing element 150 starts to compress and the guide element 50 travels axially upwardly or inwardly into the housing chamber 40 of the die housing 30 into a partially or selected retracted or stowed position. During axial movement of the cartridge casing and the guide element 50, the pin portion 126 of the ejector pin 120 travels through the opening in the guide flange element and into the cartridge casing. When the cartridge casing approaches a natural limit of travel, the pin portion 116 engages the spent primer within the cartridge casing, applying pressure to the biasing element 140 through the ejector rod 100. Further travel of the cartridge casing causes the ejector rod 100 to bottom out against the cap element 20. This is facilitated by the limited but permissible axial movement of the extension component 102 within the cap bore 26 of the cap flange element 24. This allows full pressure of the pin portion 116 of the ejector pin 110 (e.g., decapping pin) to be applied to the primer, pressing it out of the primer pocket of the cartridge casing. The removal of the primer from the cartridge casing can suddenly release the pressure on the ejector pin 110 and the ejector rod 100, allowing the rebound biasing element 140 to snap back to its original position, thereby allowing the inertia of the motion of the spent primer that may be attached to the decapping pin to be ejected from the pin portion 116 either by movement or by contact with the guide flange element. Upon removal of the cartridge casing, the return biasing element 150 pushes the guide element 50 back into the original deployed position, ready for the next cartridge casing. As described herein, the first or top end portion of the guide element is always retained in the housing chamber during use. The ejector pin can be a separate component, as shown, or can be formed on the bottom portion of the ejector rod. The separate ejector pin enables the user to insert pins of different types.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

Having described the invention, what is claimed as new and desired to be secured by Letters Patent is:

I claim:

1. A reloading die for reloading an ammunition cartridge, comprising a die housing having a main body having a first end and an opposed second end, the main body having an outer surface and an opposed inner surface forming a housing chamber, a cap element coupled to the first end of the die housing, and a guide element coupled to the second end of the die housing for mounting at least in part in the housing chamber, the guide element having a main body having a first end portion and an opposed second end portion and an inner surface defining a guide chamber, wherein the first end portion has a first guide opening formed therein at a first end face for communicating with the guide chamber and the second end portion has a second guide opening formed therein at a second end face for communicating with the guide chamber, wherein the inner surface of the guide element has disposed at a position axially spaced from the first end portion and from the second end portion a radially inwardly extending guide flange element, wherein the guide flange element has a guide flange opening formed therein, and wherein the guide flange element forms, from the guide chamber, an upper guide chamber and a lower guide chamber, wherein the guide element is axially movable within the housing chamber.

2. The reloading die of claim 1, wherein the cap element has a main body having an outer surface and an inner surface forming a cap chamber, wherein the inner surface of the main body of the cap element has a cap flange element extending axially inwardly into the cap chamber and is sized and configured to form a first spring seat for seating one end of a first biasing member.

3. The reloading die of claim 2, wherein the cap flange element has a central opening formed therein that communicates with the cap chamber.

4. The reloading die of claim 3, wherein the first end of the die housing has a neck portion having threads formed on an outer surface thereof, and wherein at least a portion of the inner surface of the cap element has threads formed thereon for threadingly engaging with the neck portion.

5. The reloading die of claim 4, wherein the first end of the die housing has a shoulder portion formed thereon disposed adjacent to the neck portion and having a diameter that is greater than a diameter of the neck portion.

6. The reloading die of claim 1, wherein the second end of the main body of the die housing has a radially inwardly extending housing flange portion disposed at the end face that has a bore opening formed therein for communicating with the housing chamber.

7. The reloading die of claim 6, wherein the first end portion of the guide element has a diameter that is greater than a diameter of the bore opening formed in the housing flange portion of the die housing so as to retain the guide element within the housing chamber.

8. The reloading die of claim 1, wherein the inner surface of the guide flange element in the lower guide chamber is relatively flat at least adjacent to the second guide opening at the end face.

9. The reloading die of claim 8, wherein the first guide opening opens onto the upper guide chamber and the second guide opening opens onto the lower guide chamber, wherein the lower guide chamber has a lower chamber section disposed at the end face region that has a flat inner surface that extends axially from the second guide opening at least partly along the lower guide chamber, and an upper chamber section adjacent to the lower chamber section and axially spaced away from the second guide opening, and wherein the lower chamber section has a flat inner wall and wherein the upper chamber section has a curved inner surface that terminates at the guide flange element.

10. The reloading die of claim 9, wherein the upper guide chamber has a relatively flat inner surface that terminates in a curved wall surface adjacent to the guide flange element forming a second spring seat for a second biasing member.

11. The reloading die of claim 1, wherein the first end of the die housing has a neck portion having threads formed on an inner surface thereof, further comprising a spacer element having a main body having a top portion forming a shoulder region and an extension portion that extends axially outwardly from the top portion, wherein the top portion has a diameter that is greater than a diameter of the extension portion and of the neck portion, and wherein the extension portion has threads formed thereon for engaging with the threads on the inner surface of the neck portion, and wherein the main body of the spacer element has a central spacer opening formed therein that extends through the main body and wherein the extension portion of the spacer element seats within the neck portion and within the chamber housing.

12. The reloading die of claim 11, wherein the cap element has a main body having an outer surface and an inner surface forming a cap chamber, wherein the inner surface of the main body of the cap element has a cap flange element extending axially inwardly into the cap chamber and sized and configured to form a first spring seat for seating one end of a first biasing element, wherein the cap flange element has a cap bore formed therein that communicates with the cap chamber, further comprising an ejector rod having a main body having:

a top section that seats within the cap chamber and is mounted between the spacer element and the cap flange element when assembled, wherein the top section includes a shoulder portion that extends radially outwardly from the main body, the shoulder portion being sized and dimensioned to abut against the top portion of the spacer element, and an extension component that extends axially outwardly from a top surface of the top section that is sized and configured to seat within the cap bore formed in the cap flange element, wherein the extension component is axially movable within the cap bore, an intermediate portion axially extending within the housing chamber, and a bottom portion having a pin bore formed therein, wherein at least a portion of the intermediate portion seats within the central spacer opening of the spacer element to position and guide the ejector rod within the housing chamber, and wherein the top section is sized and configured to seat within the cap chamber and is mounted between the spacer element and the cap flange element.

13. The reloading die of claim 12, wherein the first biasing element seats about the cap flange element and is captured between the cap element and the shoulder portion of the top section of the ejector rod, wherein the first biasing element applies a force against the top section of the ejector rod to place the shoulder portion in contact with the spacer element.

14. The reloading die of claim 13, further comprising an ejector pin sized and configured for mounting in the pin bore, the ejector pin having a main body that includes an upper portion that has threads formed thereon for threadingly engaging with the pin bore, an intermediate portion, and a pin end portion disposed opposite the upper portion.

15. The reloading die of claim 14, further comprising a second biasing element mounted within the housing chamber of the die housing and positioned to contact at one end a bottom surface of the extension portion of the spacer element and at an opposite end with the guide flange element of the guide element in the upper guide chamber.

16. The reloading die of claim 15, wherein the ejector pin is aligned with the guide flange opening, and wherein the guide element is movable between a deployed position and a retracted position, and wherein when disposed at least in the retracted position, a portion of the ejector pin passes through the guide flange opening.

17. A reloading die for removing a spent primer from an ammunition casing, comprising a die housing having a main body having a first end and an opposed second end, the main body having an outer surface and an opposed inner surface forming a housing chamber, a spacer element coupled to the first end of the die housing and having a central spacer opening, an ejector rod having a main body having a top section, an intermediate section and a bottom section, wherein the top section is sized and configured to contact the spacer element and a portion of the intermediate section seats within the central spacer opening, an ejector pin coupled to the bottom section of the ejector rod, a cap element coupled to the first end of the die housing and having an inner surface forming a cap chamber, wherein at least the top section of the ejector rod seats within the cap chamber, a first biasing member disposed in the cap chamber and contacting the top section of the ejector rod and the inner surface of the cap element, a guide element coupled to the second end of the die housing and for mounting at least in part in the housing chamber, the guide element having a main body having a first end portion and an opposed second end portion and an inner surface defining a guide chamber, and a second biasing member disposed within the housing chamber and coupled at a first end to the spacer element and coupled at a second end to the guide element.

18. The reloading die of claim 17, wherein the second end of the second biasing member seats within the guide chamber.

19. The reloading die of claim 18, wherein the inner surface of the guide element has a guide flange element formed thereon for seating the second end of the second biasing member.

20. The reloading die of claim 19, wherein the guide flange element is disposed in the guide chamber between the first end portion and second end portion.

* * * * *